US007128467B2

(12) United States Patent
Philip et al.

(10) Patent No.: US 7,128,467 B2
(45) Date of Patent: Oct. 31, 2006

(54) THERMISTOR PROBE ASSEMBLY AND METHOD FOR POSITIONING AND MOISTURE PROOFING THERMISTOR PROBE ASSEMBLY

(75) Inventors: Jimmy Philip, Kerala (IN); Sunil Balakrishnan Earath, Karnataka (IN); Poovanna Kushalappa Theethira, Karnataka (IN)

(73) Assignee: General Electric Company, Niskayuna, NY (US)

( * ) Notice: Subject to any disclaimer, the term of this patent is extended or adjusted under 35 U.S.C. 154(b) by 35 days.

(21) Appl. No.: 10/802,339

(22) Filed: Mar. 18, 2004

(65) Prior Publication Data

US 2005/0207473 A1 Sep. 22, 2005

(51) Int. Cl.
*G01K 7/00* (2006.01)
*H01C 1/02* (2006.01)

(52) U.S. Cl. ..... 374/185; 374/208; 338/28; 338/229

(58) Field of Classification Search ..... 374/185, 374/183, 208; 338/22 R, 30, 28, 252, 253, 338/229, 275, 25, 29
See application file for complete search history.

(56) References Cited

U.S. PATENT DOCUMENTS 4,538,927 A * 9/1985 Jochemczyk et al. ..... 374/163
4,548,780 A * 10/1985 Krohn ..... 264/272.15
5,221,916 A * 6/1993 McQueen ..... 338/24
5,456,682 A * 10/1995 Edwards et al. ..... 606/31
5,720,556 A * 2/1998 Krellner ..... 374/185
6,127,915 A * 10/2000 Gam et al. ..... 338/28
6,305,841 B1 * 10/2001 Fukaya et al. ..... 374/185
6,338,571 B1 * 1/2002 Chen ..... 374/208
6,485,175 B1 * 11/2002 Nimberger et al. ..... 374/142
6,639,505 B1 * 10/2003 Murata et al. ..... 338/25
6,676,290 B1 * 1/2004 Lu ..... 374/163
2002/0071475 A1 * 6/2002 Betzner et al. ..... 374/185
2002/0131477 A1 * 9/2002 Kurano ..... 374/185
2002/0172258 A1 * 11/2002 Adachi et al. ..... 374/185
2003/0058920 A1 * 3/2003 Lyle ..... 374/185
2003/0146819 A1 * 8/2003 Shibayama ..... 338/22 R
2003/0147452 A1 * 8/2003 Adachi et al. ..... 374/185

FOREIGN PATENT DOCUMENTS

EP 0691705 B1 9/2002
JP 06151653 5/1994

* cited by examiner

*Primary Examiner*—Diego Gutierrez
*Assistant Examiner*—Mirellys Jagan
(74) *Attorney, Agent, or Firm*—William E. Powell, III; Donald S. Ingraham

(57) ABSTRACT

A thermistor probe assembly with a thermistor element and a positioning device for positioning the thermistor element at a pre-determined location within the assembly. The positioning device includes a cavity extending through it, at least three self-centering lobes, and a relief groove for adjusting a dimension of the cavity. The thermistor probe assembly also includes a moisture proof molding material which encases the thermistor element and positioning device.

18 Claims, 5 Drawing Sheets

THERMISTOR PROBE ASSEMBLY AND METHOD FOR POSITIONING AND MOISTURE PROOFING THERMISTOR PROBE ASSEMBLY

BACKGROUND

The present invention relates generally to thermistor probes, and more specifically to a thermistor probe assembly and method for positioning and moisture proofing a thermistor probe assembly.

A thermistor probe is generally used for sensing a temperature response in a variety of applications, such as, for example, refrigeration, air conditioning and other cooling applications. A typical thermistor probe includes a thermistor element embedded inside a packaging for ruggedness. It has been found that sensor response varies based upon the location of the thermistor probe within the packaging. Conventional processes for packaging thermistor probes are manual, and hence the location of the thermistor probes within the packaging is entirely dependent upon the skill of the operator.

For measurement accuracy, it is useful if the packaging of a thermistor probe is moisture proof. In particular, when thermistor probes are used in low temperature applications, the insulation charactertistics of the thermistor probe is essential. In such environments any moisture ingress affects the electrical behaviour of the probe and therefore, the accuracy and reliability of its performance. Typically, the thermistor probe is sealed against moisture by disposing a shield on the thermistor probe using a multi-stage injection molding process. This manufacturing process requires a high cycle time and does not ensure repeatability in the accurate positioning of the thermistor inside the packaging.

Accordingly, there is a need in the art of manufacturing thermistor probes for an improved packaging technique that gives consistency in the measurement response by more accurately positioning the thermistor element inside the thermistor packaging at a desired position, while concurrently achieving moisture proofing with a lower production time.

SUMMARY

One aspect of the invention is a thermistor probe assembly including a thermistor element and a positioning device for positioning the thermistor element at a pre-determined location within the assembly.

Another aspect of the invention is a positioning device for centering a thermistor element within a thermistor probe assembly. The positioning device includes a cavity extending through the positioning device. The positioning device also includes at least three self-centering lobes adapted to position the thermistor element within the thermistor probe assembly, and a relief groove is positioned between two of the at least three self-centering lobes.

Another aspect of the invention is a method for manufacturing a thermistor probe assembly. The method includes inserting a thermistor element that is coupled to a conductor material through a cavity in a positioning device. An insulating material is disposed over the conductor material. A surface energy enhancing material is provided over the conductor material. A material is molded over the thermistor element and the positioning device using a single stage molding process. In this aspect, the positioning device includes a cavity extending through the positioning device, at least three self-centering lobes, and a relief groove positioned between two of the at least three self-centering lobes.

These and other advantages and features will be more readily understood from the following detailed description of preferred embodiments of the invention that is provided in connection with the accompanying drawings.

DETAILED DESCRIPTION OF PREFERRED EMBODIMENTS

Figure 1:
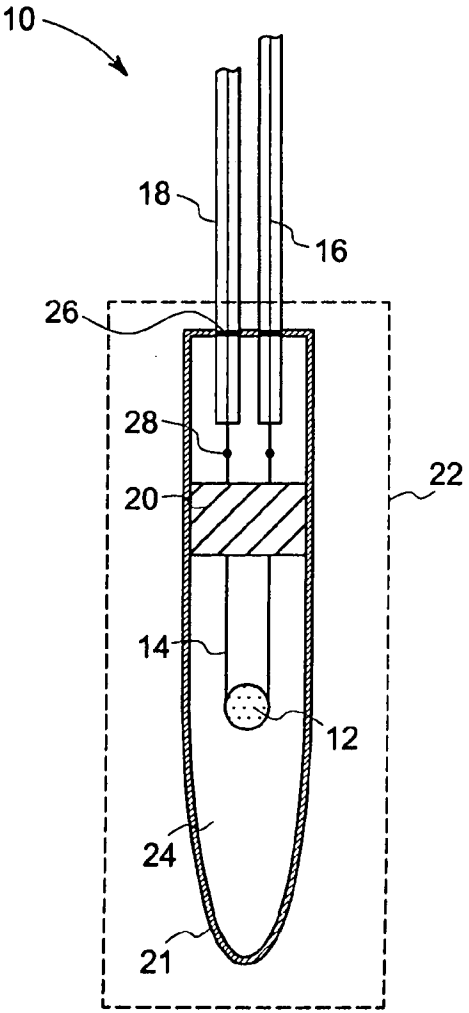
FIG. 1 is a cross-sectional view of a thermistor probe assembly including a thermistor element and a positioning device constructed in accordance with an exemplary embodiment of the invention.

Referring now to FIG. 1, a thermistor probe assembly 10 includes a thermistor element 12, a positioning device 20 and a moisture proof shield 22. The thermistor element 12 may have a profile that is square or circular in shape. The thermistor element 12 may be constructed from ceramic materials, although other types of materials with similar properties may be used. The thermistor element 12 is coupled to a conductor material 16 through lead wires 14. The illustrated conductor material 16 includes a copper alloy, such as, but not limited to, brass. In general, a thermistor probe assembly may include two or more lead wires to provide the desired coupling. The illustrated lead wires 14 include a conductive material, such as, but not limited to, steel and copper. The coupling 28 between the lead wires 14 and the conductor material 16 may be accomplished by soldering. Alternatively, the lead wires 14 may be coupled to the conductor material 16 by spot welding.

In the illustrated embodiment, the thermistor probe assembly 10 includes an insulating material 18 disposed about the conductor material 16. A moisture proof shield 22 is disposed to cover the thermistor element 12 and the positioning device 20. Moreover, the moisture proof shield 22, may include a surface energy enhancing material 26 disposed on the conductor material 16 inside the thermistor probe assembly 10. Surface energy enhancing materials 26 include, for example, Loctite P770, Loctite P7452, Loctite P34589, all of which are manufactured and marketed by Henkel and Loctite Corporation and P cyclohexane, that is commercially available in the market.

In the illustrated embodiment, the moisture proof shield 22 may include a molding material 24 to cover the thermistor element 12 and the positioning device 20. The positioning device 20 with the thermistor element 12 positions itself with reference to the shell 21 of the moisture proof shield 22 inside the thermistor probe assembly 10. As will be appreciated by those skilled in the art, the molding material 24 is compatible with the insulating material 18, disposed over the conductor material 16.

Figure 2:
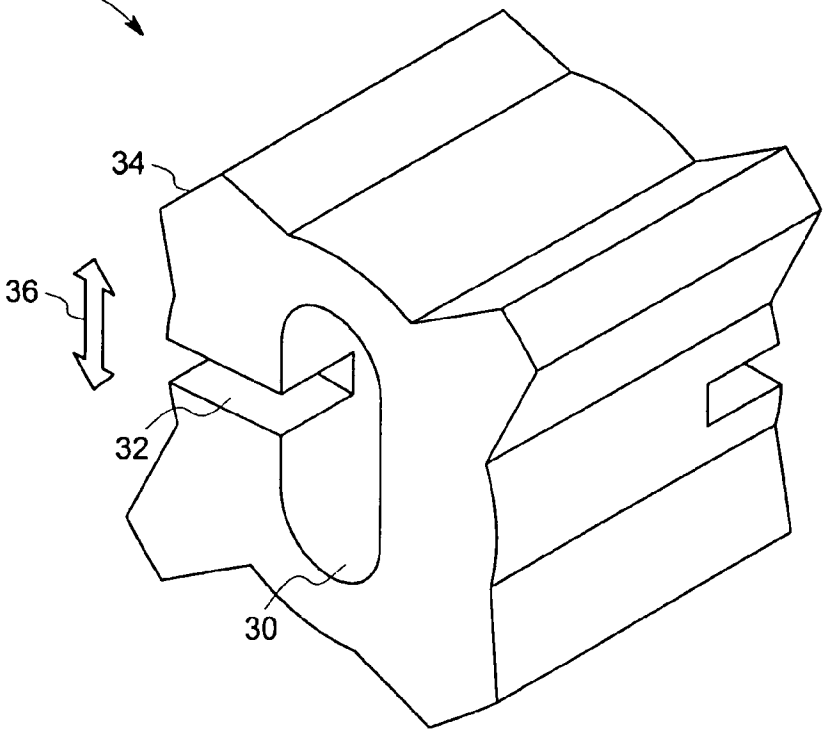
FIG. 2 is a perspective view of the positioning device of FIG. 1.

The positioning device 20 is further illustrated in FIG. 2 as including a cavity 30. The cavity 30 extends through the positioning device 20 and functions to receive the thermistor element 12. The positioning device includes self-centering lobes 34, which are configured to position the thermistor element 12 within the thermistor probe assembly 10 by abutting an inside surface of shell 21 of the moisture proof shield 22 as shown in FIG. 1. Typically, a minimum of three self-centering lobes 34 are used for positioning the thermistor element 12 inside the thermistor probe assembly 10, although the number of the self centering lobes 34 may be more than three based on the dimensions of the positioning device 12.

The illustrated positioning device 20 includes a relief groove 32 located between two of the at least three self-centering lobes 34. The relief groove 32 is configured to adjust a dimension of the cavity 30 in the direction of the arrow 36 as shown in FIG. 2, for placing the thermistor element 12 within the positioning device 20. Typically, the positioning device 20 may be formed with a material compatible with the insulating material 18 disposed about the conductor material 16. The positioning device 20 may be formed from polyvinyl chloride or polybutylene terephthalate or a combination thereof.

The positioning device 20 is adapted to position the thermistor element 12 at a pre-determined location of the thermistor probe assembly 10. The pre-determined location may be centered at a central location within the thermistor probe assembly, namely at a location that is equidistant to three or more positions on the exterior of the thermistor probe assembly 10. The positioning device 20 also may be used as a general positioning device for certain other systems and applications.

Figure 3:
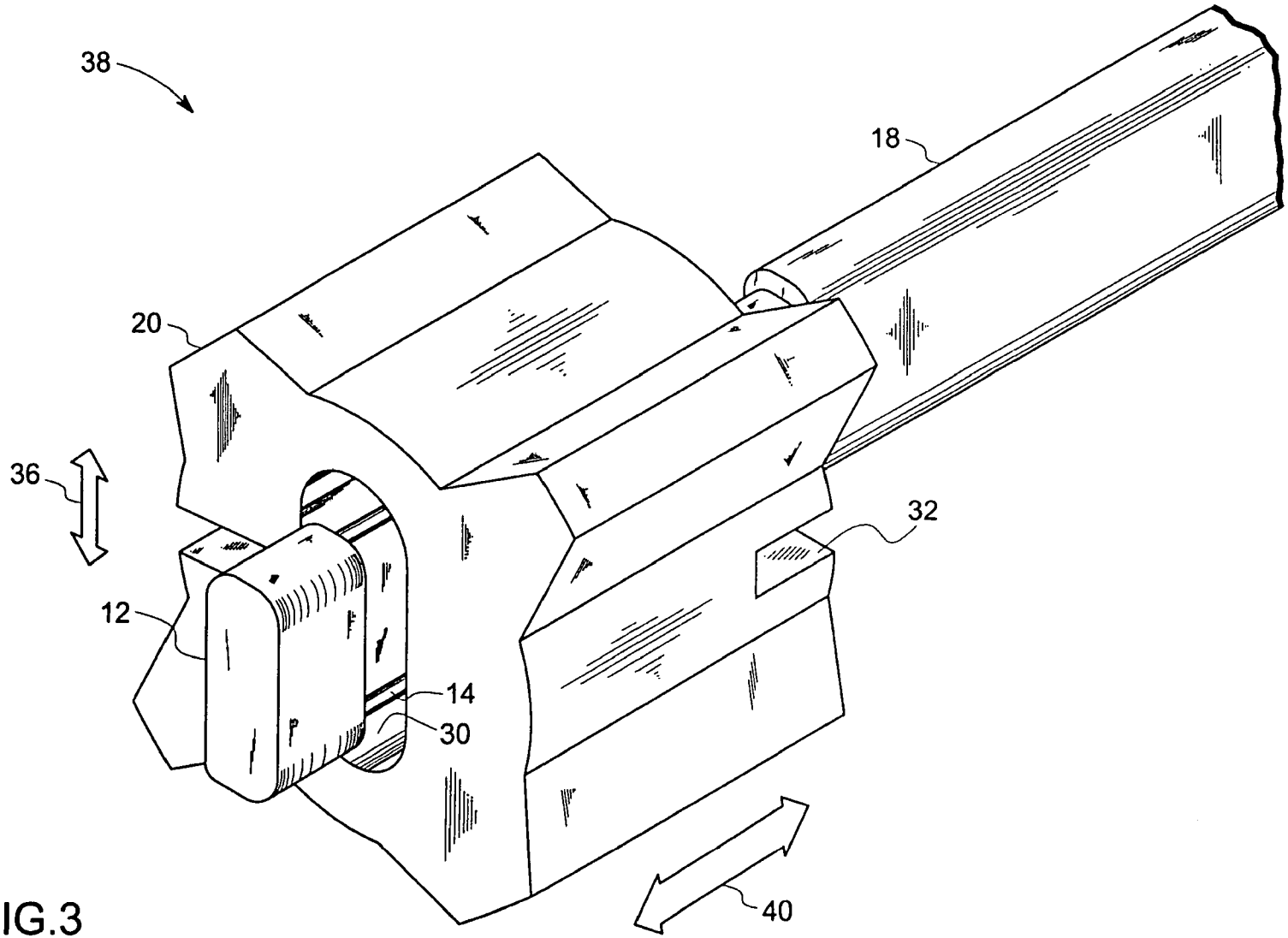
FIG. 3 is a perspective view illustrating placement of the thermistor element of FIG. 1 within the positioning device of FIG. 1.

FIG. 3 illustrates the placement 38 of the thermistor element 12 inside the positioning device 20. The thermistor element 12 and the lead wires 14 are inserted inside the positioning device 20 in the direction of arrow 40. The direction of the insertion may be from the thermistor element 12 end. Alternatively, if the length of the lead wires 14 is small, the positioning device 20 may receive the thermistor element 12 and the lead wires 14 from the lead wires 14 end. The relief groove 32 may open up to increase the dimension of the cavity 30, thereby reducing the force required to insert the thermistor element 12 and the lead wires 14 inside the positioning device 20. Alternatively, as it will be appreciated by those skilled in the art, in certain other situations, the relief groove 32 may close and decrease the dimension of the cavity 30 to facilitate insertion of the thermistor element 12 and the lead wires 14 inside the positioning device 20.

Figure 4:
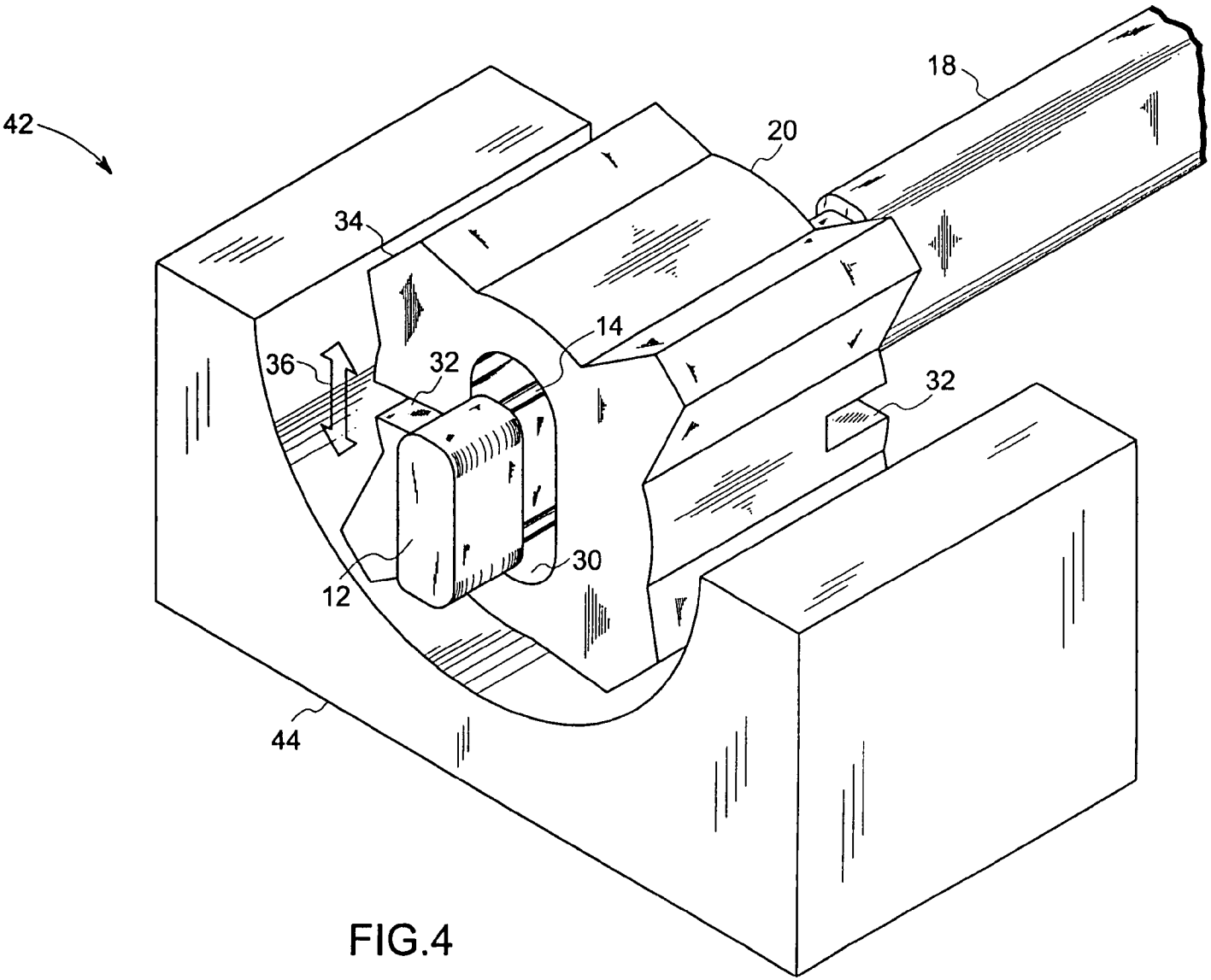
FIG. 4 is a perspective view of the placement of the thermistor element of FIG. 1 and the positioning device of FIG. 1 inside a mold cavity.
Figure 5:
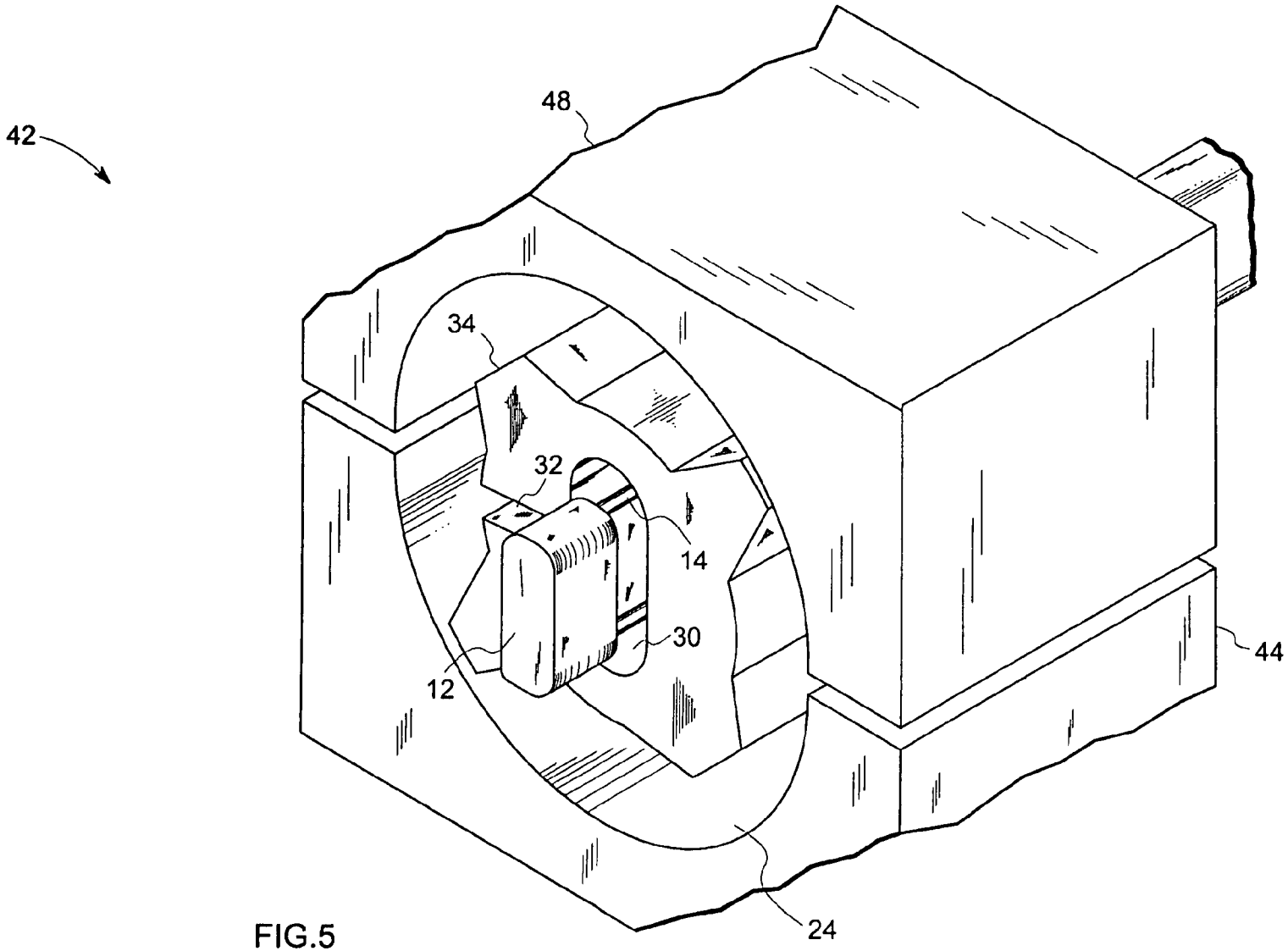
FIG. 5 is another perspective view like FIG. 4.

FIGS. 4 and 5 diagrammatically illustrate the placement of the thermistor element 12 and the positioning device 20 inside a mold cavity 42. The mold cavity 42 serves as a mold for a material which will function to achieve moisture proofing of the thermistor element 12. In operation, the thermistor element 12 with the lead wires 14 are positioned inside the positioning device 20 as described hereinabove with reference to FIG. 3. Subsequently, the thermistor element 12, lead wires 14 and the positioning device 20, are placed inside the bottom half 44 of the mold cavity 42. Moreover, the self-centering lobes 34 position themselves in the center of the mold cavity 42. Subsequently, the molding process includes covering the thermistor element 12, lead wires 14 and the positioning device 20 with the top half 48 of the mold cavity 42 and filling the mold cavity 42 with the molding material 24 using a gate and runner at a pre-set location. The relief groove 32 of the positioning device 20 provides a path to fill the cavity 30 with the molding material 24.

Figure 6:
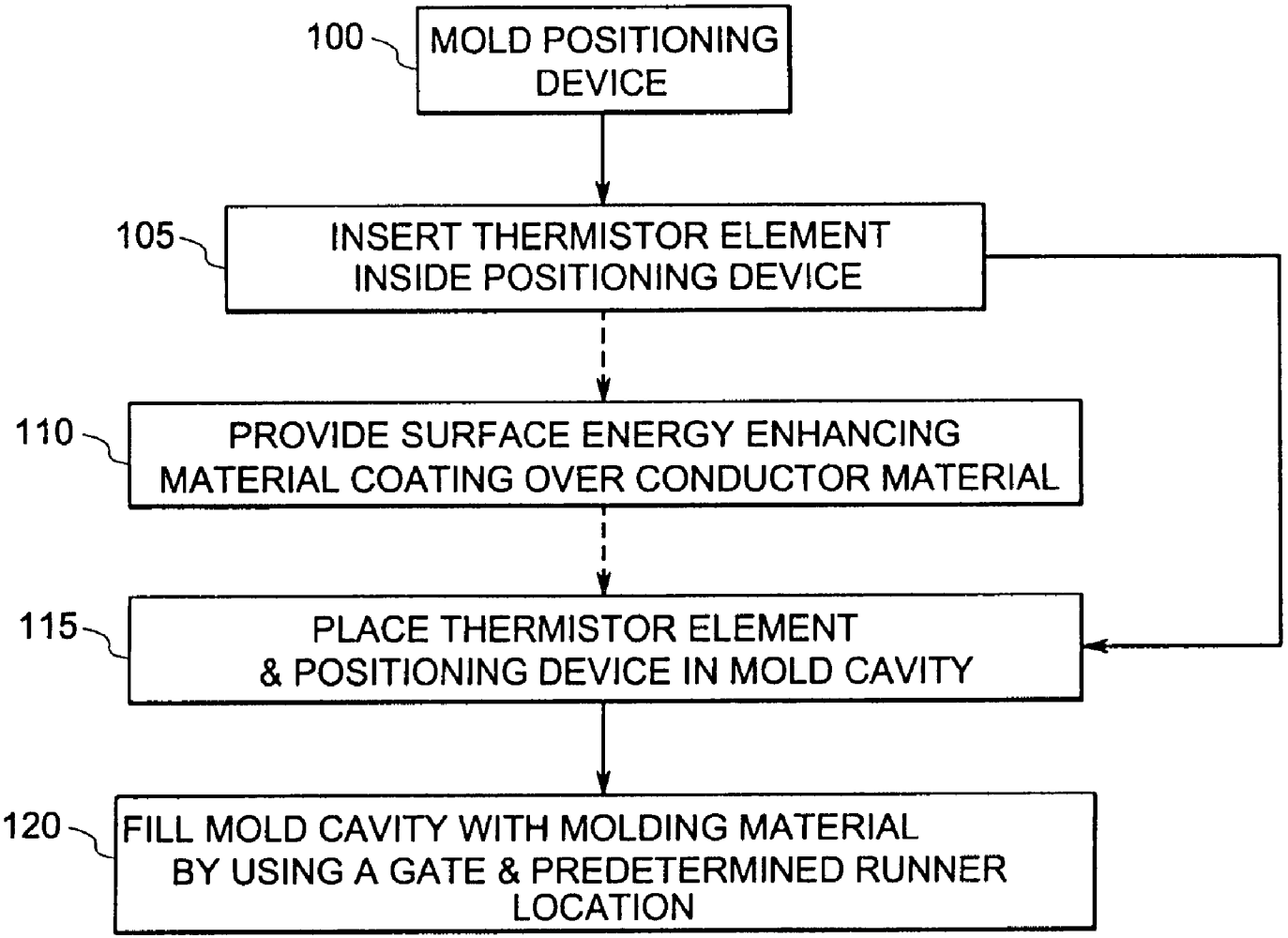
FIG. 6 illustrates process steps for manufacturing a thermistor probe assembly in accordance with another exemplary embodiment of the invention.

FIG. 6 illustrates a flow chart indicating exemplary steps in manufacturing a thermistor probe assembly 10 as described in reference to the embodiments discussed hereinabove. The process begins at Step 100, at which molding of the positioning device 20 is performed. The positioning device 20 may be molded using a single stage injection molding process. At Step 105, the thermistor element 12 is inserted inside the positioning device 20. As noted above, the thermistor element 12 and the lead wires 14 may be inserted from the thermistor element 12 end or from the lead wires 14 end. The inserting operation may involve increasing a dimension of the cavity 30 by adjusting the relief groove 32. However, in certain cases the inserting operation may involve decreasing a dimension of the cavity 30 by adjusting the relief groove 32. The lead wires 14 are coupled to the conductor material 16. It should be noted here that an insulating material 18 may be disposed over the conductor material 16 to provide electric insulation of the conductor material 16. At Step 110, a surface energy enhancing material 26 is provided over the conductor material 16. Preferably, the surface energy enhancing material 26 is coated over the conductor material 16.

Next, at Step 115, the thermistor element 12 and the positioning device 20 are placed inside the bottom half 44 of the mold cavity 42 for a single stage injection molding process. The single stage injection molding process uses a single stage reciprocating-screw machine that uses a single screw rotating and reciprocating within a barrel to melt, shear and inject molten resin into the mold of the machine. Subsequently, the thermistor element 12 and the positioning device 20 are covered from top using the top half 48 of the mold cavity 42.

At Step 120, the mold cavity 42 is filled with the molding material 24 using a gate and a runner at a pre-set location. The molding material 24 is compatible with the insulating material 18 disposed over the conductor material 16. The gate and the runner pre-set location may be downstream of the positioning device 20 to facilitate the centering of the thermistor element 12 inside the thermistor probe assembly 10.

This overall method of manufacturing thermistor probes achieves accurate positioning of the thermistor element 12 inside the thermistor probe assembly 10, while concurrently achieving moisture proofing. Moreover, an important advantage of the present system is consistency in the temperature measurement response with a lower production time.

The various aspects of the method described hereinabove have utility in industrial as well as medical environments. For example, in the automotive industry, thermistors are used for monitoring, measuring and controlling the engine performance. Also, thermistors are used to control and protect vital telecommunication equipment and other office machines. These include telephone exchanges, telephone ancillary equipment, computers, fax machines, photocopiers, battery packs, switching power supplies, pagers and printers. Thermistor sensors also find use in medical applications and are used for heart catheters, esophageal stethoscopes, thermometers, skin sensors, blood analyzers, incubators, respiration monitors, hypodermic needle sensors and many other applications. In the heating, ventilating and air conditioning area these sensors are used extensively in process control, energy management, HVAC systems, power supplies, transformers, motor soft start and general time delay units. Thus, an essential aspect of thermistor sensors is to provide high sensitivity and accuracy in measuring temperature responses. As noted above, the method described here may be advantageous for positioning of the thermistor probe within the packaging and providing moisture proofing of the thermistor probes to achieve accurate and consistent temperature measurement response in the environments mentioned above.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. A thermistor probe assembly, comprising:

a thermistor element;

a positioning device for positioning the thermistor element at a pre-determined location within the assembly; and a moisture proof shield disposed to encapsulate the thermistor clement and the positioning device, wherein the moisture proof shield comprises a surface energy enhancing material and a molding material disposed over the thermistor element and the positioning device.

2. The assembly of claim 1, wherein the thennistor element has a cross-sectional profile selected from the group consisting of a square-shaped profile and a circular-shaped profile.

3. The assembly of claim 1, wherein the thermistor element comprises a ceramic material.

4. The assembly of claim 1, wherein the positioning device comprises one or more materials selected from the group consisting of polyvinyl chloride and polybutylene terephthalate.

5. The assembly of claim 1, wherein the pre-determined location is at a central location within the thenmistor probe assembly.

6. The assembly of claim 1, wherein the positioning device comprises:

a cavity extending there through and adapted for receiving a thermistor element; at least three self-centering lobes adapted to position the thermistor element within the thermistor probe assembly; and a relief groove positioned between two of the at least three self-centering lobes.

7. The assembly of claim 6, wherein said at least three self-centering lobes are externally directed.

8. The assembly of claim 1, further comprising at least two lead wires extending from the thermistor element.

9. The assembly of claim 8, wherein the lead wires comprise steel.

10. The assembly of claim 8, wherein the lead wires comprise copper.

11. The assembly of claim 8, further comprising a conductor material coupled to the thermistor element through the at least two lead wires.

12. The assembly of claim 11, wherein the conductor material comprises brass.

13. The assembly of claim 11, further comprising an insulating material disposed over the conductor material.

14. The assembly of claim 11, wherein the surface energy enhancing material is disposed over the conductor material.

15. The assembly of claim 14, wherein the surface energy enhancing material comprises a material selected from the group consisting of Loctite P 770, Loctite P 7452, Loctite P 34589, and P cyclohexane.

16. The assembly of claim 11, further comprising an insulating material disposed over the conductor material, wherein the molding material disposed over the thermistor element and the positioning device is compatible with the insulating material disposed over the conductor material.

17. The assembly of claim 11, wherein the lead wires are soldered to the conductor material.

18. The assembly of claim 11, wherein the lead wires are spot-welded to the conductor material.

* * * * *

UNITED STATES PATENT AND TRADEMARK OFFICE

CERTIFICATE OF CORRECTION

PATENT NO. : 7,128,467 B2
APPLICATION NO. : 10/802339
DATED : October 31, 2006
INVENTOR(S) : Jimmy Philip, Balakrishnan Earath and Poovanna K. Theethira It is certified that error appears in the above-identified patent and that said Letters Patent is hereby corrected as shown below:

Claim 2, line 33, word “thennistor” should be replaced by -- thermistor --.

Claim 5, line 44, word “thenmistor” should be replaced by -- thermistor --.

Signed and Sealed this

Twenty-sixth Day of June, 2007

JON W. DUDAS
*Director of the United States Patent and Trademark Office*